US006095435A

United States Patent [19]

Greer, Jr. et al.

[11] Patent Number: 6,095,435

[45] Date of Patent: Aug. 1, 2000

[54] APPLICATOR SYSTEMS AND METHODS FOR STUCCO MATERIALS

[75] Inventors: Lester Greer, Jr., Bellingham; James A. Tryon, Seattle, both of Wash.

[73] Assignee: Homax Products, Inc., Bellingham, Wash.

[21] Appl. No.: 09/226,333

[22] Filed: Jan. 6, 1999

Related U.S. Application Data

[60] Provisional application No. 60/070,555, Jan. 6, 1998.

[51] Int. Cl.[7] ..... B05B 7/32

[52] U.S. Cl. ..... 239/369; 239/329; 239/346

[58] Field of Search ..... 239/310, 311, 239/313, 319, 329, 331, 369, 390, 391, 320, 346; 222/637, 252, 256, 262

[56] References Cited

U.S. PATENT DOCUMENTS

| | | | |
|---|---|---|---|
| 3,381,861 | 5/1968 | Stein | 222/256 |
| 4,123,005 | 10/1978 | Blunk | 239/346 X |
| 4,364,521 | 12/1982 | Stankowitz | 239/346 |
| 4,863,104 | 9/1989 | Masterson | 239/346 X |
| 4,948,054 | 8/1990 | Mills | 239/369 X |
| 4,951,876 | 8/1990 | Mills | 239/331 X |
| 5,188,295 | 2/1993 | Stern et al. | 239/369 X |
| 5,884,818 | 3/1999 | Campbell | 222/256 |
| 5,979,797 | 11/1999 | Castellano | 239/369 X |

*Primary Examiner*—Lesley D. Morris

*Attorney, Agent, or Firm*—Michael R. Schacht; Hughes & Schacht

[57] ABSTRACT

Dispensing systems and methods for stucco and similar materials. The system comprises a dispensing assembly and a cartridge assembly. The dispensing assembly comprises a piston pushing assembly, an outlet assembly, and a structural assembly for holding the piston pushing assembly in a fixed relationship to the outlet assembly. The cartridge assembly can contain the material to be dispensed and is mounted within the dispensing assembly. Operation of the piston pushing assembly forces stucco or other material to move from the cartridge assembly to a mixing chamber portion defined by the outlet assembly. At the mixing chamber portion, the stucco material is mixed with a stream of pressurized air which carries the mixture out of the system and deposits the material onto a surface to be coated. The system allows substantial control over the manner in which the stucco or other material is sprayed.

27 Claims, 2 Drawing Sheets

84
74
90
60
72
94
88
70
92
86
56
76
36
66
64
68
80
20
96
78
58
170
62
95
82
22
166
180
134
138
38
172
26
28
42
144
120
126
98
184
146
136
32
128
132
142
140
158
124
152
164
30
154
156
34
40
54
122
148
130
44
160
162
46

180
172
178

APPLICATOR SYSTEMS AND METHODS FOR STUCCO MATERIALS

RELATED APPLICATIONS

This application claims priority of Provisional Application No. 60/070,555 filed on Jan. 6, 1998.

TECHNICAL FIELD

The present invention relates to systems and methods for applying coating materials and, more specifically, to such applicator systems and methods that are adapted to deposit relatively viscous materials such as stucco material onto a surface to be coated.

BACKGROUND OF THE INVENTION

A number of systems and methods are known for spraying flowable coating materials onto surfaces such as walls, ceilings, and the like. Spray applicators for dispensing coating materials such as paint, drywall texture material, and stucco generally fall into this category. The present invention generally relates to such spray applicators, such as hopper gun applicators, that dispense discrete quantities of coating material.

The present invention is particularly suited to the dispensing of stucco material, and that application will be discussed herein in detail. As used herein, the term "stucco material" refers to spray surface coatings containing a hardenable base material and an aggregate such as sand, vermiculite, and/or perlite. Stucco material is normally, but not necessarily, a waterproof material that is applied to external wall surfaces. Stucco materials are often applied in a plurality of coats having a total thickness of at least one-eighth of an inch and normally in the range of one-half to three-quarters of an inch. Often, the stucco material is worked while it is wet to obtain a desired surface texture.

Stucco material is commonly available in one of two basic forms. Traditional stucco material comprises a dry cementitious base material (e.g. cement and lime) and sand and/or other aggregates. The dry material and aggregate material is mixed with water, applied to a surface to be coated, and allowed to set. Traditional stucco material is normally applied to a layer of wire mesh attached to the surface to be coated. Traditional stucco is built up in successive coats to the desired thickness and may be worked and painted for the desired aesthetic affect.

A more modern stucco material will be referred to herein as EIFS (Exterior Insulation and Finish Systems) stucco material. EIFS stucco material comprises an acrylic or latex base and aggregate such as sand, vermiculite, and/or perlite. EIFS stucco material is often applied to a foam layer attached to the surface to be coated. The foam layer provides insulation, while the EIFS stucco material forms both a protective, waterproof exterior surface and a desired aesthetic appearance (e.g., color, texture). The base coat normally forms the waterproof layer, while the top coat forms the aesthetic layer. Both of these basic types of stucco material are relatively viscous, and they both contain an often abrasive aggregate material.

Often, a stucco finish will become damaged. The need thus exists for convenient systems and methods for repairing either a traditional stucco finish or an EIFS stucco finish.

RELATED ART

The Applicants are not aware of any systems specifically designed to apply stucco materials in amounts appropriate for repairing an existing stucco finish.

Probably the most common technique for repairing a pre-existing stucco finish is simply to trowel a small amount of stucco material over the area to be repaired. This can be effective when the pre-existing stucco finish was originally hand worked. But in situations where the pre-existing stucco finish has simply been sprayed on and not subsequently worked by hand, the hand applied patch will not visually match the pre-existing stucco finish.

Another technique for repairing pre-existing stucco finishes is to use the same type of professional spray applicator used to apply the pre-existing stucco finish. This can result in a precise match of the pre-existing stucco finish but requires tools and expertise that commonly are unavailable to and/or too complicated for use by the non-professional. Additionally, professional spray applicators normally employ a pump that drives the stucco material through a hose to the area where the material is mixed with pressurized air. The entire hose must be filled with stucco material before any can be dispensed. Any stucco material left in the hose after the job is finished must be disposed of, which can result in significant waste on a small job.

A pre-existing stucco finish can also be repaired using hopper guns commonly used to apply drywall texture material. These hopper guns are gravity fed; the stucco material must be thinned so that it can flow from the hopper to the area where it is mixed with pressurized air. The thinned stucco material may not visually match the pre-existing stucco finish and may not have the same properties (e.g., resistance to cracking, resistance to water penetration) as the pre-existing stucco finish.

The Applicants are also aware of U.S. Pat. No. 4,951,876 to Mills. This patent describes a spray tip designed for use with a caulking tube. The material within the caulking tube is squeezed out of the caulking tube and into an area where the material is mixed with pressurized air. The device disclosed in the '876 patent does not disclose, teach, or suggest that this system be applied to the application of stucco materials. The spray tip is simply pressed onto the end of the caulking tube; the pressure generated when expelling highly viscous materials such as stucco material would cause the spray tip to slide off of the end of the caulking tube. The spray tip is also designed such that highly viscous materials such as stucco material would clog this tip, rendering it impractical for use with such materials.

OBJECTS OF THE INVENTION

From the foregoing, it should be apparent that one important object of the present invention is to provide improved systems and methods for dispensing stucco material.

Another more specific object of the present invention is to provide systems and methods for dispensing stucco material having a favorable mix of the following characteristics:

- Easy for use by the non-professional;
- Convenient for use on small jobs such as repair jobs;
- Does not result in excessive waste of stucco material;
- Can be used to dispense coating materials other than stucco material, even if these materials are less viscous than stucco material;
- Allow the material to be dispensed in any one of a plurality of patterns; and
- Can be manufactured relatively inexpensively.

SUMMARY OF THE INVENTION

The present invention is a system and method for dispensing a range of coating materials, including materials such as stucco material that are highly viscous and include abrasive aggregates.

The system comprises a cartridge assembly for containing the material to be dispensed, an outlet assembly, a piston assembly, and a structural assembly. The structural assembly mounts the cartridge assembly between the outlet assembly and the piston assembly and maintains the outlet assembly and piston assembly a predetermined distance from each other. A source of pressurized air is attached to the outlet assembly. The piston assembly drives the material out of the cartridge assembly and into the outlet assembly where the material is mixed with the pressurized air. The pressurized air carries the material out of the outlet assembly through an outlet opening. The piston assembly is hand-operated and provides the user with a mechanical advantage to facilitate driving of the material out of the cartridge assembly.

The outlet assembly preferably redirects the material being dispensed from a material axis defined by the piston assembly to a dispensing axis defined by the pressurized air. This redirection occurs before the material is mixed with the pressurized air so that the material travels along a straight path (defined by the dispensing axis) after it has been mixed with the pressurized air.

The outlet assembly is preferably provided with a nozzle member through which the pressurized air passes as it enters the mixing area. The nozzle member may be fixed at different locations relative to the outlet opening to adjust the amount of material mixed with the pressurized air. This allows the pattern in which the texture material is sprayed to be adjusted.

The outlet member is also preferably provided with an outlet member that defines the outlet opening. The outlet member may be changed to change the properties of the outlet opening such as total cross-sectional area, shape, and/or number of openings.

The cartridge assembly can be preloaded at the factory with EIFS stucco material, which will stay liquid until mixed with air. In this case, the stucco material will be contained within a sealed product casing contained within a housing cylinder. The sealed product casing may be removed and kneaded to remix the solids and fluids after long storage times. Traditional cement based stucco material can be mixed in small batches on site and placed into a housing cylinder forming part of the cartridge assembly.

DETAILED DESCRIPTION OF THE INVENTION

Figure 1:
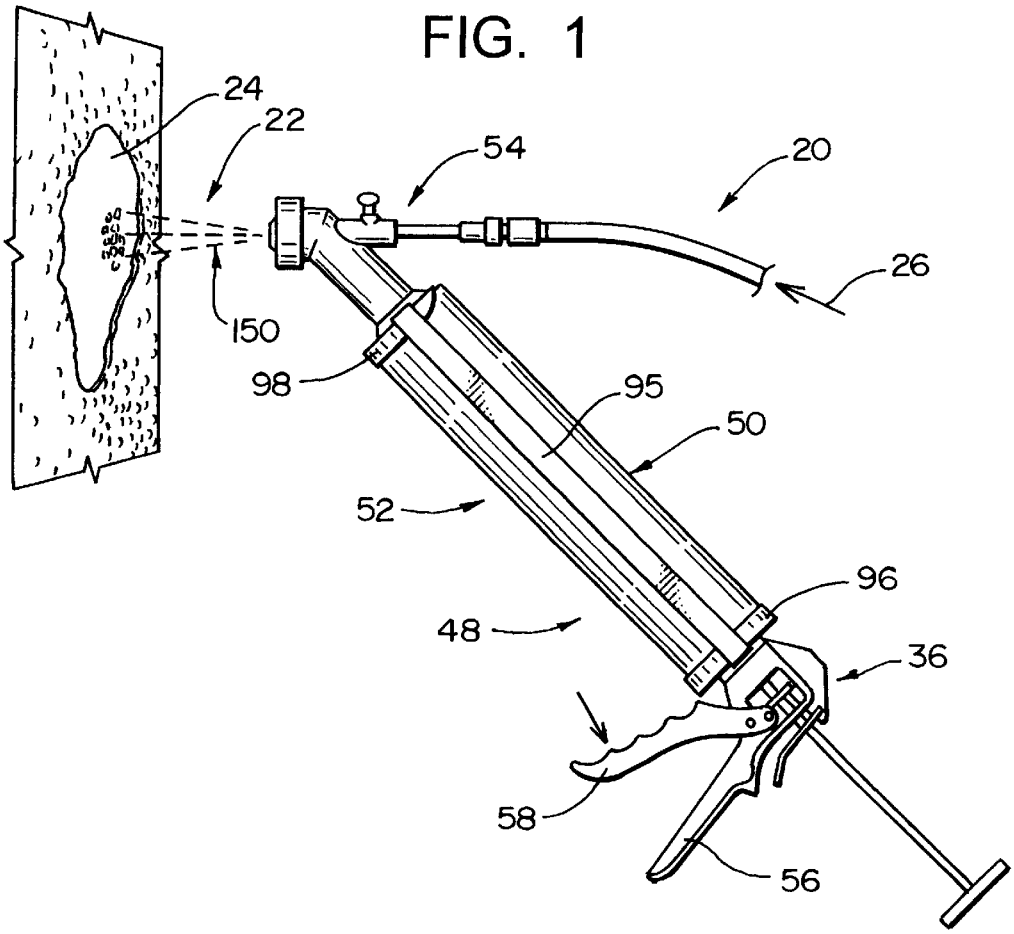
FIG. 1 is a partial, perspective view depicting a system for applying stucco material constructed in accordance to the teachings of the present invention.

Referring initially to FIG. 1, depicted therein is an applicator system 20 constructed in accordance with, and embodying, the principles of the present invention. The applicator system 20 allows stucco material 22 to be applied to a surface such as an exterior wall surface 24. The present invention may additionally be used to dispense other materials; one important feature of the present invention is thus that it can be used to dispense both stucco material and other similar relatively viscous coating materials such as drywall texture material and the like.

The applicator 20 may be used to apply either traditional or EIFS stucco material. The following discussion relates to the application of either type of stucco material unless it is specifically stated that a given feature is to be used with only one type of stucco material.

Figures 3, 4:
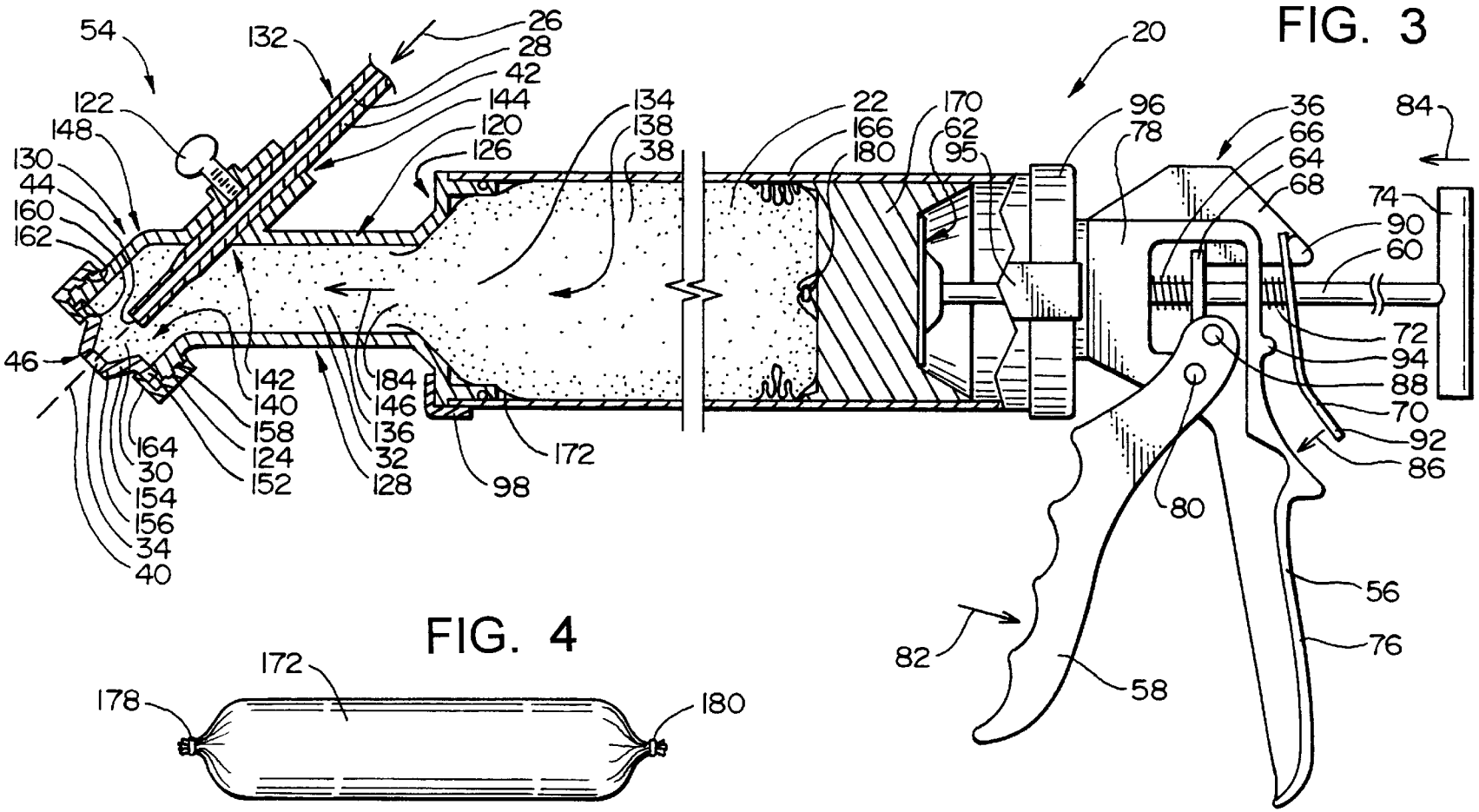
FIG. 3 is a side, elevational view depicting a product container that forms a part of the cartridge assembly depicted in FIG. 2.
FIG. 4 is a side, elevational view depicting an exemplary product casing that may form part of the product container depicted in FIG. 3.

Referring now to FIG. 3, the basic operation of the applicator system 20 will be described. Pressurized air represented by an arrow 26 flows through an air passageway 28, into a mixing portion 30 of an outlet chamber 32, and out of an outlet opening 34. A piston pushing assembly 36 forces the stucco material 22 from a storage chamber 38 into the mixing portion 30 of the outlet chamber 32, where the pressurized air 26 carries the stucco material 22 out of the outlet opening 34 along a dispensing axis 40. The dispensing axis 40 is arranged such that the stucco material 22 is deposited on the surface 24 in a desired manner.

The system 20 comprises a number of subsystems that allow the manner in which the stucco material 24 is deposited on the surface 22 to be controlled. One or more of these subsystems can be adjusted to obtain what will be referred to as a desired stucco pattern. Each of these subsystems will be discussed briefly below.

First, the piston pushing assembly 36 controls the rate at which stucco material 22 is forced out of the storage chamber 38 and thus the rate at which the stucco material 22 is mixed with the pressurized air 26 and carried onto the surface 24. This mixture rate will have a strong influence on the manner in which stucco material is deposited on a surface.

Second, the air passageway 28 is defined by a nozzle member 42. The nozzle member 42 also defines an air outlet 44 through which the pressurized air 26 exits the air passageway 28. The nozzle member 42 is movable such that a distance between the air outlet 44 and the outlet opening 34 may be changed. Moving the air outlet 44 farther form the outlet opening 34 causes the air 26 to force a greater amount of stucco material 22 out of the outlet opening 34. Further increasing the distance between the outlet 44 and opening 34 increases the allowable particle size of the sprayed stucco material and reduces the velocity of the stucco material 22 as it leaves the system 20. The particle size and velocity of the stucco material as it impacts a surface to be coated also influence the look of the stucco material deposited on the surface.

Third, the outlet opening 34 is defined by an outlet member 46. The outlet member 46 may be replaced with another similar member defining an outlet opening with a different cross-sectional area. The cross-sectional area of the outlet opening affects the allowable particle size of the sprayed stucco material and thus has an effect on the applied stucco material.

Fourth, the flow rate of the pressurized air 26 may be varied; varying the flow rate of the pressurized air 26 will also affect the speed at which the stucco material is carried out of the system 20 and thus the manner in which the stucco material is deposited on the surface to be coated.

The system 20 thus allows the user to control a number of factors that effect the manner in which the stucco material 22 is deposited on the surface 24. Perhaps the most common use of the system 20 will be to allow a user to match an existing stucco surface for repair and other jobs. The desired stucco pattern is thus the pattern of the existing stucco surface. A user of the system 20 may also obtain a desired stucco pattern for a new installation of stucco material and can ensure that this aesthetic effect is consistently obtained throughout the new installation.

With the foregoing general understanding of the operation of the applicator system 20, the details of construction and use of this system 20 will now be discussed. In the following discussion, the terms "front", "back", "top", and "bottom" refer to the left, right, top, and bottom of FIG. 3. In this context, terms such as "vertical" and "lateral" are relative to the system 20 and not true vertical or horizontal.

Referring for a moment back to FIG. 1, the applicator system 20 basically comprises a dispensing assembly 48, a cartridge assembly 50, and a source (not shown) of the pressurized air 26.

The source of pressurized air is or may be conventional and need not be described herein in detail. A compressor or tank of compressed air that provides a regulated stream of air will commonly form the pressurized air source. This source should include a variable valve for varying the flow rate of the pressurized air 26; such valves are well-known in the art and also need not be described in detail herein.

The dispensing assembly 48 comprises the piston pushing assembly 36, a structural assembly 52, and an outlet assembly 54.

Referring initially to the piston pushing assembly 36, as perhaps best shown in FIG. 3 the piston pushing assembly 36 comprises first and second handle members 56 and 58, a piston rod 60, a piston head 62, a friction plate 64, a return spring 66, a stop member 68, a latch member 70, a latch spring 72, and a T-bar 74.

The first handle member 56 comprises a handle portion 76 and a housing portion 78. The first handle member 56 is fixed relative to the dispensing assembly 48. The second handle member 58 rotates about an axis defined by a pivot pin 80 fixed to the housing portion 78. The piston head 62 is attached to the piston rod 60. The piston rod 60 is mounted to the housing portion 78 such that it can move along its longitudinal axis. The piston rod 60 passes through orifices (not shown) in the friction member 64 and latch member 70.

Movement of the second handle member 58 in the direction shown by arrow 82 in FIG. 3 causes axial movement of the piston rod 86 in the forward direction shown by arrow 84. And by rotating the latch member 70 in the direction shown by arrow 86, the piston rod 60 may be moved in a direction opposite to that shown by arrow 84.

In particular, a link pin 88 is connected to the second handle member 58 and contacts the friction member 64. Normally, the friction member 64 is vertically aligned and the piston rod 60 may freely move relative to the friction member 64. When the second handle member 58 is moved towards the first handle member 56, the link pin 88 engages the friction member 64 and causes this member 64 to move out of vertical alignment against the force of the return spring 66. When out of vertical alignment, the friction member 64 frictionally engages the piston rod 60 such that continued movement of the second handle member 58, and thus, the friction member 64, moves the piston rod 60 in the direction shown by arrow 84.

When pressure on the second handle member 58 is released, the return spring 66 forces the friction member 64 back into vertical alignment so that it no longer frictionally engages the rod 60. The return spring 66 will then force the friction member 64 in a direction opposite that shown by arrow 84 relative to the rod 60 until the friction member 64 engages the stop member 68.

Whenever the friction member 64 is vertically oriented, it does not prevent movement of the piston rod 60. Accordingly, the latch member 70 is arranged such that it frictionally engages the piston rod 60 out of sequence from the friction member 64. In particular, the latch spring 72 normally forces the latch member 70 against a latch projection 90 on the stop member 68 to maintain the latch member 70 slightly out of vertical. When slightly out of vertical, the latch member 70 frictionally engages the piston rod 60 to prevent the rod 60 from moving backwards. When the friction member 64 moves the rod 60 forward, the rod 60 frictionally engages the latch member 70 to move it toward a vertical position in which the rod 60 may move with little resistance relative to the latch member 70. The latch member 70 thus prevents back pressure on the piston head 62 from forcing the piston rod 60 backwards when pressure on the second handle member 58 is released but allows the friction member to move the piston rod 60 forward.

If the piston head 62 needs to be retracted to change cartridge assemblies, a distal end 92 of the latch member 70 is simply depressed until the latch member contacts a handle projection 94 on the first handle member 56. At this point, neither the friction member 64 nor the latch member 92 frictionally engages the piston rod 60, and the rod 60 may be moved back by grasping and pulling the T-bar 74. This allows a spent cartridge assembly to be removed and replaced.

Successive squeezing of the handle members 56 and 58 thus causes the piston head 62 to move forward in discrete increments. The length of the increment can be adjusted simply by displacing the second handle member 58 only partly towards the first handle member 56. The rate at which the members 56 and 58 are squeezed together will also affect the texture pattern. Additionally, the location of the link pin 88 relative to the pivot pin 80 creates a mechanical advantage that increase the pressure that is applied by the piston head 62. The piston pushing assembly 36 thus allows fine control over the pressure applied to the stucco material 22.

The piston pushing assembly 36 described above is usually made of metal and is particularly suited for use with the system 20, but other materials and assemblies that obtain a similar effect may be used. For example, a piston pushing assembly employing a ratchet and pawl arrangement may be suitable. Important characteristics of any such piston pushing assembly are that the piston pushing assembly should create a mechanical advantage to help force the relatively viscous stucco material out of the system 20 and should allow relatively fine control of the rate at which stucco material is dispensed.

The structural assembly 52 simply maintains a predetermined separation between the piston pushing assembly 36 and the outlet assembly 54. The exemplary structural assembly 52 comprises a pair of tie-rod members 95 (only one shown) and first and second end caps 96 and 98. The tie-rod members 95 are rigidly connected between the end caps 96 and 98. The first end cap 96 is secured to the housing portion 78 of the first handle member 56. And as will be explained in further detail below, the second end cap 98 is secured to the outlet assembly 54. The tie-rod members 95 ensure that the outlet assembly 54 does not move relative to the piston pushing assembly 36 when the piston pushing assembly 36 applies pressure to the stucco material 22. The exact details of any structural assembly used are not critical to the present invention as long as the structural assembly substituted for the assembly 36 performs the same function.

The outlet assembly 54 comprises a housing member 120, the nozzle member 42, a set screw 122, the outlet member 46, and a retaining ring 124. All of these exemplary members 42, 46, 120, 122, and 124 are cast out of zinc/aluminum alloy or similar metal such as zinc, aluminum, brass, or steel. The outlet assembly 54 is thus relatively inexpensive and rugged enough for commercial use, especially given the often abrasive nature of stucco-type materials and the relatively high pressures required to dispense these materials. Other materials such as thermoplastics and/or composites may be used, however, depending upon such factors as tooling costs, production costs, and desired durability.

The housing member 120 comprises a cap portion 126, a neck portion 128, an outlet portion 130, and a nozzle portion 132. The housing member 120 is hollow and defines the outlet chamber 32 described above. The outlet chamber 32 comprises an inlet portion 134 defined by the housing cap portion 126, an intermediate portion 136 defined by the housing neck portion 128, and the mixing portion 30, which is defined by the housing outlet portion 130. The outlet chamber 32 has an upstream opening 138, a downstream opening 140, and a nozzle opening 142. The housing nozzle portion 132 defines a nozzle chamber 144 that communicates with the outlet chamber 32 through the nozzle opening 142.

The nozzle member 42 and nozzle chamber 144 are designed with nearly identical cross-sectional areas such that the nozzle member 42 may be snugly received within the nozzle chamber 144.

The set screw 122 is threaded through the housing nozzle portion 132. When the nozzle member 42 is within the nozzle chamber 144, the set screw 122 may be tightened such that it forces the nozzle member 42 against the nozzle housing nozzle portion 132. This fixes the position of the nozzle member 42 relative to the housing member 120 at a desired location. When the set screw 122 is loosened, the nozzle member 42 may be moved relative to the housing member 120 to adjust a position of the air outlet 44 relative to the outlet opening 34 as generally described above.

Of importance to the dispensing of stucco material are the spatial relationships among the various portions of the outlet chamber 32, the nozzle chamber 144, and the dispensing axis 40.

In particular, the exemplary inlet, intermediate, and mixing portions 134, 136, and 30 of the outlet chamber 32 are generally cylindrical (except at the locations where one portion transitions to an adjacent portion) and define longitudinal axes. The longitudinal axes of the inlet portion 134 and the intermediate portion 136 are aligned along what will be referred to as a material axis. The material axis is aligned with the longitudinal axis of the piston rod 60 and is schematically depicted by an arrow 146 in FIG. 3. The stucco material 22 flows generally along this material axis 146 as it is forced out of the chamber 38.

The exemplary nozzle chamber 144 and air passageway 28 are cylindrical, and their longitudinal axes are aligned with each other and with the longitudinal axis of the mixing portion 30 of the outlet chamber 32.

The nozzle portion 132 of the housing member 120 is arranged such that nozzle chamber 144 is located opposite the downstream opening 140. The longitudinal axes of the nozzle chamber 144, air passageway 28, and outlet chamber mixing portion 30 are all aligned with the dispensing axis 40.

The dispensing axis 40 is offset at an angle $\alpha$ relative to the material axis 146. The stucco material 22 thus flows along the material axis 146 until it reaches a corner location 148, at which point the stucco material turns and begins flowing along the dispensing axis 40. In the exemplary system 20, this offset angle $\alpha$ is approximately 45°, is preferably between 30° and 60°, and in any event should be between 10° and 150°.

The spatial relationships among these various chambers and chamber portions are desirable for at least the following reasons.

First, when applying the stucco material to walls, the offset angle allows the user to hold the system with the material axis slanted upward and the dispensing axis generally horizontal, which is a comfortable, natural position for the user. When used with ceilings, this system can simply be inverted such that the material axis is at an angle with respect to horizontal and the dispensing axis is pointed generally upward.

Second, all of the functions described above can be implemented in an outlet assembly 54 that comprises only four relatively simple parts that may be easily manufactured, assembled, and disassembled quickly and easily.

Third, the nozzle chamber 144 is angled away from the flow of the stucco material 22 in a manner that inhibits stucco material from flowing out of this chamber 144 between the nozzle member 42 and the nozzle portion 132 of the housing member 120. Under most conditions, this obviates the need for a seal between the nozzle member 42 and the nozzle portion 132, which further simplifies the construction of the assembly 54.

Fourth, the air passageway 28 is arranged such that it directs the pressurized air 26 towards the center of the outlet opening 34 and such that the stucco material 22 flows to this opening 34 from all sides. This ensures that the pressurized air 26 acts with the same pressure on all of the stucco material 22 flowing towards the opening 34. The stucco material 22 is sprayed in small particles 150 (FIG. 1), and the size of these particles 150 is kept more constant than if the air 26 acted with unequal pressure on the material 22 as it is dispensed.

Referring now to the exemplary outlet member 46, this member 46 is symmetrical and has an annular portion 152, a frustoconical portion 154, and a central portion 156. The outlet opening 34 is a circular through-hole formed in the central portion 156. Additional outlet members such as the member 46 may be supplied with the system, with each of these outlet members having an outlet opening (or possibly openings) of a different cross-sectional area or shape. If a plurality of outlet members are provided, a desired outlet member is selected as necessary to obtain the desired texture pattern.

The exemplary outlet opening 34 has a cross-sectional area of approximately 0.250". In other embodiments, the outlet opening may have a cross-sectional area of between 0.125" and 0.375" and in any event should be between 0.062 and 0.500".

The retaining ring 124 engages the outlet member 120 to detachably attach the outlet member 46 to the housing member 120. In particular, the housing neck portion 130 has a threaded exterior surface portion 158 and an interior surface portion defining an annular notch 160. The retaining ring 124 has a threaded interior surface portion 162 and a retaining flange 164. The outlet member 46 is arranged such that its annular portion 152 is closely received within the annular notch 160. The retaining ring 124 is then rotated relative to the housing member 120 such that the threaded portions 158 and 162 engage each other. Tightening the retaining ring 124 onto the housing member 120 causes the retaining flange 164 to act on the annular portion 152 of the outlet member 46 and hold this annular portion 152 in the annular notch 160. The outlet member 46 may be removed simply by reversing this process. It should be clear that the functions of the retaining ring and the outlet member may be combined into one part.

Figure 2:
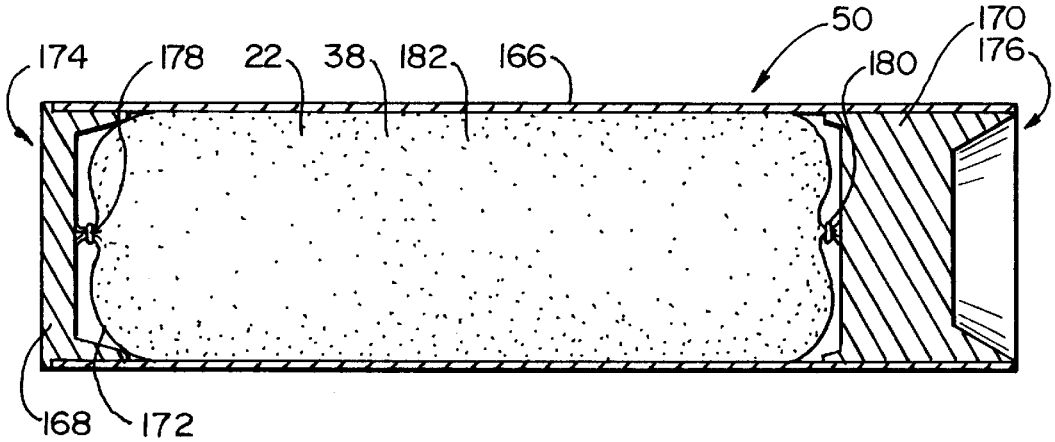
FIG. 2 is a side, elevational, cut-away view depicting a cartridge assembly used by the system depicted in FIG. 1.

The cartridge assembly 50 will now be discussed in detail. As shown in FIG. 2, the exemplary cartridge assembly 50 comprises a housing cylinder 166, an end cap 168, a piston cap 170, a product casing 172, and a quantity of the stucco material 22.

The housing cylinder 166 and caps 168 and 170 are made of plastic, fiberboard, or other similar material. The housing cylinder 166 has first and second end openings 174 and 176. The end cap 168 is detachably attached to the housing cylinder 166 to cover the first end opening 174. The piston cap 170 is slideably received within and covers the second end opening 176. The housing cylinder 166 defines the product chamber 38 described above.

Referring now to FIG. 4, the exemplary product casing 172 is a length of flexible, cylindrical material having two open ends, although one end may be sealed when the casing 172 is formed. The material is placed within cylindrical casing and the open ends are sealed shut using fasteners 178 and 180 (if two are required) to define a casing chamber 182. The fasteners 178, 180 may be short lengths of wires as shown or other fasteners such as twist ties or a heat seal. The material from which the casing 172 is made is strong enough to resist tearing under normal use and prevents air from entering or liquids from exiting the casing chamber 182.

At the factory, the product casing 172 is filled with a quantity of stucco material and sealed. The product casing 172 is then placed into the product chamber 38, with the caps 168 and 170 covering the end openings 174 and 176 as described above. This forms the cartridge assembly 50 that contains the stucco or other material 22 during shipping, storage, and use. Alternately, with one end formed closed or closed using a fastener, the casing 172 may be filled while inside the chamber 38 and then the open end thereof sealed.

The cartridge assembly 50 may be shipped and stored for months or years before it is used. Immediately prior to use, the end cap 168 is removed from the housing cylinder 166 to expose the product casing 172. The end of the product casing 166 may be cut or is removed adjacent to the fastener 178 (or otherwise sealed end) to form an opening 184 (FIG. 3). The outlet assembly 54 is next placed in the end of the cylinder 166. The cartridge 50 and outlet assembly 54 are then inserted into the dispensing assembly 48 (FIG. 1) as shown in FIG. 3. By squeezing the handle members 56 and 58 as described above, the piston member 62 forces the piston cap 170 in the direction shown by arrow 146 as described above.

The aggregate within the stucco material 22 is usually more dense than the base in which it is suspended and, over time, can settle within the product casing 172. If this occurs, the product casing 172 is removed from the product chamber 38 before the outlet assembly 54 is inserted onto the dispensing assembly 48. The product casing 172 is kneaded to mix the aggregate more thoroughly throughout the material 22 and then placed back into the product chamber 38. The cartridge assembly is then used as described above. The product casing 172 should be oversized to facilitate this re-mixing process.

The exemplary cartridge assembly 50 is specifically designed for dispensing EIFS stucco material having an acrylic or latex base. Unlike traditional stucco material having a cement base, the acrylic or latex base of the EIFS stucco material does not harden until it comes in contact with air. Alternatively, acrylic or latex based material may be purchased in one to five gallon pails and loaded into the cylinder 166 without a casing.

If traditional stucco material is to be used, the stucco material may be obtained separately, mixed on the site, and introduced directly into the housing cylinder 166. The product casing may not be required in this case, but otherwise the dispensing process is substantially the same as described above.

Alternatively, dry stucco premix material may be sold in cartridge form in the same manner as the cartridge assembly 50. In this case, the method of fabricating the cartridge assembly would be essentially the same, the only difference being that the stucco material is in a dry, pre-mix form when it is sealed within the product casing. Prior to use, the dry stucco material would be mixed with an appropriate amount of water either in the housing cylinder or outside of the housing cylinder and reintroduced into the housing cylinder. From that point, the dispensing process would be substantially the same as that described above.

From the foregoing, it should be clear that the present invention may be embodied in forms other than the one described above without departing from the principles of the present invention. Accordingly, it should be recognized that various modifications can be made without departing from the basic teaching of the present invention. The scope of the invention should thus not be determined by the foregoing detailed description.

What is claimed is:

1. A system for spraying material onto a surface to be coated, comprising:

an outlet assembly defining an outlet opening and an outlet chamber containing a mixing area;

a piston assembly for allowing a piston to be driven by hand with increased mechanical advantage;

a cartridge assembly for containing the material;

a structural assembly for supporting the cartridge assembly between the outlet assembly and the piston assembly such that operation of the piston assembly forces the material out of the cartridge assembly and into the mixing chamber where the material is mixed with pressurized air and carried out of the system through the outlet opening; wherein the outlet chamber redirects the material forced out of the cartridge assembly before the material is mixed with the pressurized air.

2. A system as recited in claim 1, in which the material is stucco material.

3. A system as recited in claim 1, in which the outlet assembly further comprises a nozzle member that directs pressurized air to the mixing area.

4. A system as recited in claim 3, in which the nozzle member defines a nozzle opening through which pressurized air enters the mixing area, where the nozzle member is movable such that a location of the nozzle opening relative to the outlet opening may be changed.

5. A system as recited in claim 4, in which the outlet assembly further comprises means for fixing the location of the nozzle opening relative to the outlet opening.

6. A system as recited in claim 1, in which the outlet assembly further comprises a plurality of outlet members, where each outlet member defines a different outlet opening, each outlet opening corresponds to a different spray pattern, and one of the outlet members is selected based on a desired spray pattern.

7. A system as recited in claim 1, in which the cartridge assembly comprises a relatively rigid housing member and a relatively non-rigid casing member, where the material is contained within the casing member and the casing member is contained within the housing member.

8. A system as recited in claim 7, in which the material hardens upon contact with the air and the casing member is sealed until immediately prior to use of the material contained therein.

9. A system as recited in claim 1, in which the cartridge assembly comprises a relatively rigid housing member and a piston cap, where the material is contained within the housing member and the piston member acts on the material through the piston cap.

10. A method of spraying material onto a surface to be coated, comprising the steps of:

providing an outlet assembly defining an outlet opening;

providing a piston assembly for allowing a piston to be driven by hand with increased mechanical advantage;

providing a cartridge assembly for containing the material;

connecting a structural assembly to the outlet assembly and the piston assembly such that a distance between the outlet assembly and the piston assembly is fixed;

inserting the cartridge assembly between the outlet assembly and the piston assembly;

operating the piston assembly to force the material out of the cartridge assembly along a material axis and into a mixing area located within outlet assembly adjacent to the outlet opening;

redirecting the flow of texture material within the outlet assembly before the texture material enters the mixing area such that the texture material flows along a dispensing axis that extends at an angle relative to the material axis; and introducing pressurized air into the mixing area such that the pressurized air carries the material out of the system through the outlet opening.

11. A method as recited in claim 10, further comprising the step of providing the outlet assembly with a nozzle member that defines a nozzle opening through which pressurized air passes into the mixing area.

12. A method as recited in claim 11, further comprising the step of moving the nozzle member to adjust a location of the nozzle opening relative to the outlet opening.

13. A method as recited in claim 12, further comprising the step of fixing the location of the nozzle opening relative to the outlet opening at a desired location corresponding to a desired spray pattern.

14. A method as recited in claim 10, in which the step of providing the cartridge member comprises the steps of:

placing the material within a relatively non-rigid casing member; and placing the casing member and material within a relatively rigid housing member.

15. A method as recited in claim 14, in which the material hardens upon contact with the air, further comprising the step of sealing the material within the casing member until immediately prior to use.

16. A method as recited in claim 10, in which:

the step of providing the outlet assembly further comprises the step of providing a plurality of outlet members, where each outlet member defines a different outlet opening and each outlet opening corresponds to a different spray pattern; and the method further comprises the step of selecting one of the outlet members based on a desired spray pattern.

17. A system for spraying stucco material onto a surface to be coated, comprising:

an outlet assembly comprising a housing member defining a mixing area, a nozzle member defining a nozzle opening and a dispensing axis, and an outlet member defining an outlet opening, where the outlet member is attached to the housing member such that the outlet opening is adjacent to the mixing area;

the nozzle member adapted to be attached to a source of pressurized air such that the nozzle member directs pressurized air through the nozzle opening, through the mixing area, and out of the system through the outlet opening, and the nozzle member is movable relative to the housing member to vary a distance between the nozzle opening and the outlet opening;

a piston assembly for allowing a piston to be driven by hand with increased mechanical advantage;

a cartridge housing;

a structural assembly for supporting the cartridge housing between the outlet assembly and the piston assembly such that operation of the piston assembly forces the material out of the cartridge assembly and into the mixing area.

18. A system for spraying material onto a surface to be coated, comprising:

an outlet assembly defining an outlet opening and a mixing area and further comprising a nozzle member that directs pressurized air to the mixing area, where the nozzle member is movable such that a location of the nozzle opening relative to the outlet opening may be changed;

a piston assembly for allowing a piston to be driven by hand with increased mechanical advantage;

a cartridge assembly for containing the material;

a structural assembly for supporting the cartridge assembly between the outlet assembly and the piston assembly such that operation of the piston assembly forces the material out of the cartridge assembly and into the mixing chamber where the material is mixed with pressurized air and carried out of the system through the outlet opening; wherein the outlet chamber redirects the material forced out of the cartridge assembly before the material is mixed with the pressurized air.

19. A system for spraying material onto a surface to be coated, comprising:

an outlet assembly defining an outlet opening and a mixing area and further comprising a plurality of outlet members, where each outlet member defines a different outlet opening, each outlet opening corresponds to a different spray pattern, and one of the outlet members is selected based on a desired spray pattern;

a piston assembly for allowing a piston to be driven by hand with increased mechanical advantage;

a cartridge assembly for containing the material;

a structural assembly for supporting the cartridge assembly between the outlet assembly and the piston assembly such that operation of the piston assembly forces the material out of the cartridge assembly and into the mixing chamber where the material is mixed with pressurized air and carried out of the system through the outlet opening.

20. A system for spraying material onto a surface to be coated, comprising:

an outlet assembly defining an outlet opening and a mixing area;

a piston assembly for allowing a piston to be driven by hand with increased mechanical advantage;

a cartridge assembly for containing the material, the cartridge assembly comprising a relatively rigid housing member and a relatively non-rigid casing member, where the material is contained within the casing member and the casing member is contained within the housing member;

a structural assembly for supporting the cartridge assembly between the outlet assembly and the piston assembly such that operation of the piston assembly forces the material out of the cartridge assembly and into the mixing chamber where the material is mixed with pressurized air and carried out of the system through the outlet opening.

21. A system as recited in claim 20, in which the material hardens upon contact with the air and the casing member is sealed until immediately prior to use of the material contained therein.

22. A system for spraying material onto a surface to be coated, comprising:

an outlet assembly defining an outlet opening and a mixing area;

a piston assembly for allowing a piston to be driven by hand with increased mechanical advantage;

a cartridge assembly for containing the material, the cartridge assembly comprising a relatively rigid housing member and a piston cap, where the material is contained within the housing member and the piston member acts on the material through the piston cap;

a structural assembly for supporting the cartridge assembly between the outlet assembly and the piston assembly such that operation of the piston assembly forces the material out of the cartridge assembly and into the mixing chamber where the material is mixed with pressurized air and carried out of the system through the outlet opening.

23. A method of spraying material onto a surface to be coated, comprising the steps of:

providing an outlet assembly defining an outlet opening;

providing the outlet assembly with a nozzle member that defines a nozzle opening;

providing a piston assembly for allowing a piston to be driven by hand with increased mechanical advantage;

providing a cartridge assembly for containing the material;

connecting a structural assembly to the outlet assembly and the piston assembly such that a distance between the outlet assembly and the piston assembly is fixed;

inserting the cartridge assembly between the outlet assembly and the piston assembly;

operating the piston assembly to force the material out of the cartridge assembly along a material axis and into a mixing area located within outlet assembly adjacent to the outlet opening;

moving the nozzle member to adjust a location of the nozzle opening relative to the outlet opening; and introducing pressurized air into the mixing area such that the pressurized air passes through the mixing area and carries the material out of the system through the outlet opening.

24. A method as recited in claim 23, further comprising the step of fixing the location of the nozzle opening relative to the outlet opening at a desired location corresponding to a desired spray pattern.

25. A method of spraying material onto a surface to be coated, comprising the steps of:

providing an outlet assembly defining an outlet opening;

providing a piston assembly for allowing a piston to be driven by hand with increased mechanical advantage;

placing the material within a relatively non-rigid casing member;

placing the casing member and material within a relatively rigid housing member to form a cartridge assembly;

connecting a structural assembly to the outlet assembly and the piston assembly such that a distance between the outlet assembly and the piston assembly is fixed;

inserting the cartridge assembly between the outlet assembly and the piston assembly;

operating the piston assembly to force the material out of the cartridge assembly along a material axis and into a mixing area located within outlet assembly adjacent to the outlet opening;

introducing pressurized air into the mixing area such that the pressurized air carries the material out of the system through the outlet opening.

26. A method as recited in claim 25, in which the material hardens upon contact with the air, further comprising the step of sealing the material within the casing member until immediately prior to use.

27. A method of spraying material onto a surface to be coated, comprising the steps of:

providing an outlet assembly comprising a plurality of outlet members, where each outlet member defines a different outlet opening and each outlet opening corresponds to a different spray pattern;

selecting one of the outlet members based on a desired spray pattern;

providing a piston assembly for allowing a piston to be driven by hand with increased mechanical advantage;

providing a cartridge assembly for containing the material;

connecting a structural assembly to the outlet assembly and the piston assembly such that a distance between the outlet assembly and the piston assembly is fixed;

inserting the cartridge assembly between the outlet assembly and the piston assembly;

operating the piston assembly to force the material out of the cartridge assembly along a material axis and into a mixing area located within outlet assembly adjacent to the outlet opening;

introducing pressurized air into the mixing area such that the pressurized air carries the material out of the system through the outlet opening of the selected outlet member.

* * * * *